US006752087B1

(12) United States Patent
Taylor

(10) Patent No.: US 6,752,087 B1
(45) Date of Patent: Jun. 22, 2004

(54) VEHICLE WITH A STEERABLE WHEELSET

(75) Inventor: Scott Phillip Neale Taylor, Carlingford (AU)

(73) Assignee: Bishop Austrans Limited, North Ryde (AU)

( * ) Notice: Subject to any disclaimer, the term of this patent is extended or adjusted under 35 U.S.C. 154(b) by 0 days.

(21) Appl. No.: 10/049,414

(22) PCT Filed: Jul. 28, 2000

(86) PCT No.: PCT/AU00/00898

§ 371 (c)(1),
(2), (4) Date: Feb. 27, 2002

(87) PCT Pub. No.: WO01/10697

PCT Pub. Date: Feb. 15, 2001

(30) Foreign Application Priority Data

Aug. 10, 1999 (AU) ..... PQ2103
Dec. 1, 1999 (AU) ..... PQ4352

(51) Int. Cl.[7] ..... B61F 5/38
(52) U.S. Cl. ..... 105/168; 105/165
(58) Field of Search ..... 105/165, 168, 105/199.6, 167, 180, 169, 199.2, 4.4; 280/124.171; 104/298, 295; 246/122 R; 267/246

(56) References Cited

U.S. PATENT DOCUMENTS

| | | | | |
|---|---|---|---|---|
| 4,000,702 A | | 1/1977 | Makintosh | |
| 4,301,899 A | * | 11/1981 | McSparran et al. | 191/3 |
| 4,982,671 A | * | 1/1991 | Chollet et al. | 105/168 |
| 5,588,367 A | * | 12/1996 | Scheffel | 105/168 |
| 5,730,064 A | * | 3/1998 | Bishop | 105/168 |
| 6,092,468 A | * | 7/2000 | Hase | 105/73 |
| 6,360,998 B1 | * | 3/2002 | Halvorson et al. | 246/122 R |

FOREIGN PATENT DOCUMENTS

| | | | | |
|---|---|---|---|---|
| EP | 945327 A2 | * | 9/1999 | B62D/01/26 |
| WO | WO 9407728 A1 | * | 4/1994 | B61F/05/38 |
| WO | WO 9418048 | | 8/1994 | |
| WO | WO 9520704 | | 8/1995 | |

* cited by examiner

*Primary Examiner*—Frantz F. Jules
(74) *Attorney, Agent, or Firm*—Ladas & Parry

(57) ABSTRACT

A vehicle where respective inwardly inclined wheels (15) of a steerable wheelset run on respective inwardly sloping faces (54) of a guideway having centreline (39). The vehicle having sensing means for sensing lateral didsplacement of the wheelset relative to a longitudinal reference path. The sensing means signalling a control system including actuating means to steer the wheelset in response to sensed lateral displacement thereof.

5 Claims, 7 Drawing Sheets

VEHICLE WITH A STEERABLE WHEELSET

TECHNICAL FIELD

This invention relates to a vehicle with a steerable wheelset. Whilst the invention is primarily described with an embodiment particularly suited for use with Automated Guideway Transit (AGT) systems of the type which use small, individual vehicles, capable of operating at high speeds, the present invention is also suitable for use with a variety of other rail or guideway systems.

BACKGROUND

There are a number of known vehicles adapted to travel on rail or guideway systems which have steerable wheelsets.

One such system is disclosed in U.S. Pat. No. 4,982,671 (Chollet et al), and relates to a track guided vehicle. Such a vehicle is supported on bogies, where each bogie contains two wheelsets. Magnetic (or other) sensors are used to detect the lateral position of the bogie with respect to the track on which it is running. At least one sensor detects the angle between the two wheelsets. The two wheelsets are connected via linkages and actuators, such that the angle between the wheelsets can be altered to steer the bogie. A servo-control circuit receives signals from the sensors and controls the actuators to steer the wheelsets in response to the detected lateral position of the bogie.

Another known system is disclosed in European Patent 374,290 (Girod et al), and relates to a track guided vehicle. Such a vehicle comprises four wheels that can be independently steered. Laser sensors, located at the front and rear of the vehicle, are used to detect the difference between the track centreline and the vehicle longitudinal axis. A servo-control mechanism controls the steering actuators in order to steer the wheels in response to the sensed signals.

A disadvantage of both of these arrangements is that the lateral forces at the wheel-rail contact zone must serve a dual function, namely to steer the bogie and to oppose any lateral force, such as the centrifugal force experienced by a vehicle while cornering. Consequently the force available for steering the bogie is limited to the difference between the total available force and that already being used to oppose any external lateral forces. In a rail application where a steel wheel rolls on a steel rail, the total available force may be very low. This available force may be substantially required to react centrifugal force, with very little remaining force available to steer the wheelset leading to frequent contact between the wheel flanges and the rails.

A further known system is disclosed in U.S. Pat. No. 5,730,064 (Bishop), and relates to a self-steering bogie for track guided vehicle. The wheelsets are arranged such that a curvature in the rail generates a twist angle between the two wheelsets in the bogie when viewed in end elevation. The mechanism connecting the two wheelsets is arranged so as to steer the wheelsets, in response to rail curvature. A disadvantage of this arrangement when applied to small vehicle guideway systems, which typically use much sharper curves than normal rail systems, is the steer error resulting from twist angle supplied by rapidly changing superelevation. This may add to or subtract from the ideal steering angle required, causing the wheelset to deviate from its idealised path.

Preferably the present invention overcomes the above mentioned disadvantages by providing a vehicle with a steerable wheelset in which the effect of lateral or disturbing forces on the vehicle is minimised.

SUMMARY OF INVENTION

In one aspect the present invention is a vehicle with at least one steerable wheelset adapted to run on a guideway having two primary running faces laterally offset about a guideway centreline, the wheelset comprising a pair of wheels, each wheel located on opposite sides of the wheelset adapted to engage with a respective one of the two primary running faces, the vehicle further comprising sensing means for sensing lateral displacement of the wheelset with respect to a longitudinally disposed reference path, the sensing means producing a signal for a control system operably connected to an actuating means to steer the wheels in response to the sensed lateral displacement, characterised in that the axes of rotation of the wheels and the primary running faces are inclined downwardly towards the guideway centreline.

In a first embodiment each wheel exerts an engagement force with its respective primary running face, the engagement force on each wheel comprising a perpendicular component to its respective primary running face and a parallel component to its respective primary running face substantially transverse to the guideway centreline, wherein horizontal forces acting on the wheelset substantially perpendicular to the guideway centreline are substantially resisted by the sum of of the horizontal vectors of the perpendicular components.

In a second embodiment embodiment each wheel exerts an engagement force with its respective primary running face at a contact zone, the engagement force on each wheel comprising a first component perpendicular to its respective primary running face and a second component parallel to its respective primary running face substantially transverse to the guideway centreline, wherein a first plane perpendicular to the axis of rotation of one of the wheels passes through its respective contact zone, and a second plane perpendicular to the axis of rotation of the other wheel passes through its respective contact zone, the first and second planes intersecting along an intersection line disposed above and between the wheels, wherein horizontal forces acting on the wheelset substantially transverse to the guideway centreline at or near the intersection line are substantially resisted by perpendicular components of the engagement forces acting at the primary running faces, such that substantially all of the parallel components of the engagement forces acting at the primary running faces are available to steer the wheelset.

Preferably the intersection line passes through the centre of gravity of vehicle.

It is preferred that the sensing means comprises at least one sensor located either ahead or behind the wheelset, or laterally offset with the wheelset. Alternatively the sensing means comprises at least two sensors, one of which is located ahead of the wheelset and the other is located behind the wheelset.

It is preferred that the longitudinally disposed reference path is substantially contiguous with the guideway centreline.

Alternatively, it is preferred that the longitudinally disposed reference path is substantially parallel to, but laterally offset from the guideway centreline.

It is preferred that a secondary running face lies immediately adjacent to, and substantially parallel to, at least one primary running face.

It is preferred that the longitudinally disposed reference path is contiguous with the second running face, Alternatively, it is preferred that a secondary running face lies immediately adjacent to and substantially parallel to each primary running face and the longitudinally disposed reference path is contiguous with the lateral centreline between the respective two secondary running faces.

It is preferred that at least one of the wheels also incorporates a flange, adapted to engage with the secondary running face.

It is preferred that the control system calculates a virtual longitudinally disposed reference path which is not necessarily parallel or contiguous with the guideway centreline.

MODE OF CARRYING OUT THE INVENTION

Figure 1:
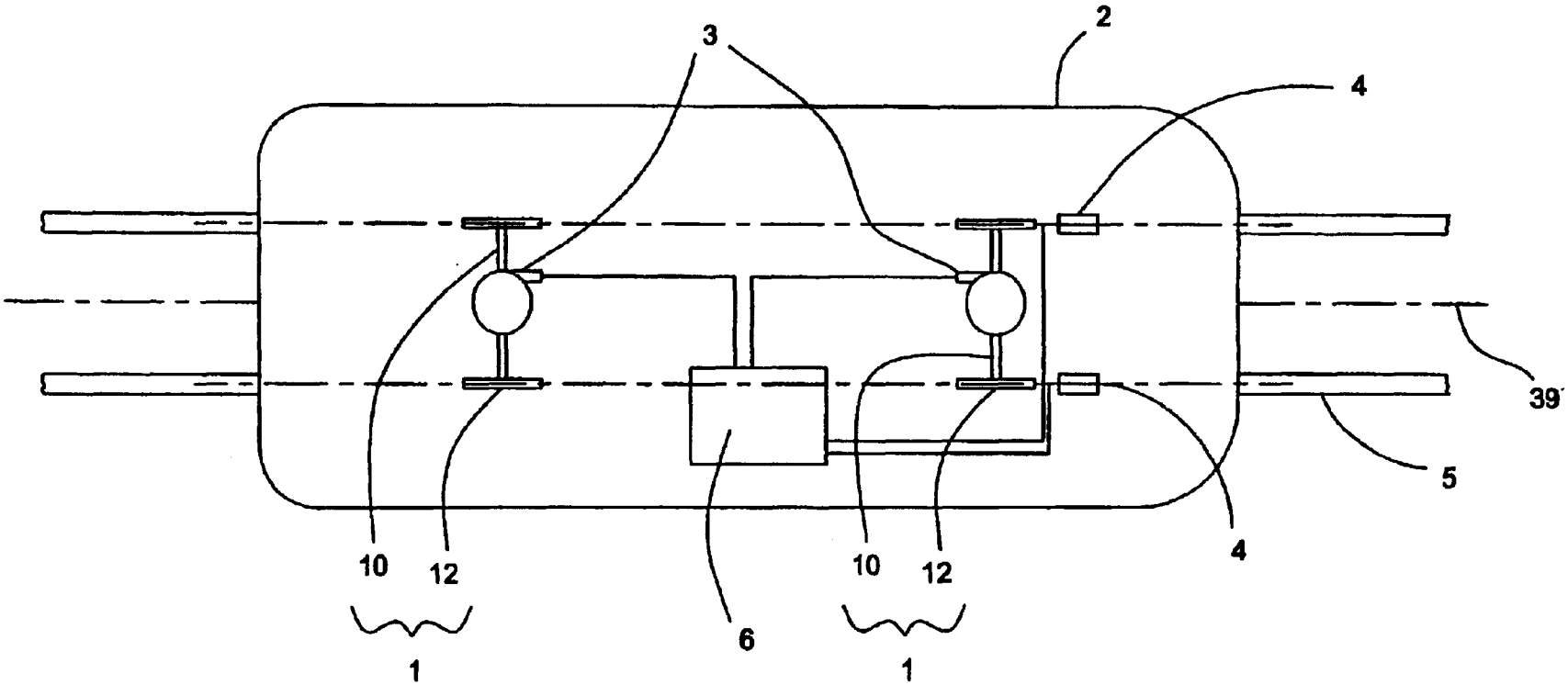
PRIOR ART Figure 1
FIG. 1 is an example of a vehicle according to the prior art, with two steerable wheelsets and incorporating steering sensors, actuators and a controller.
Figure 2:
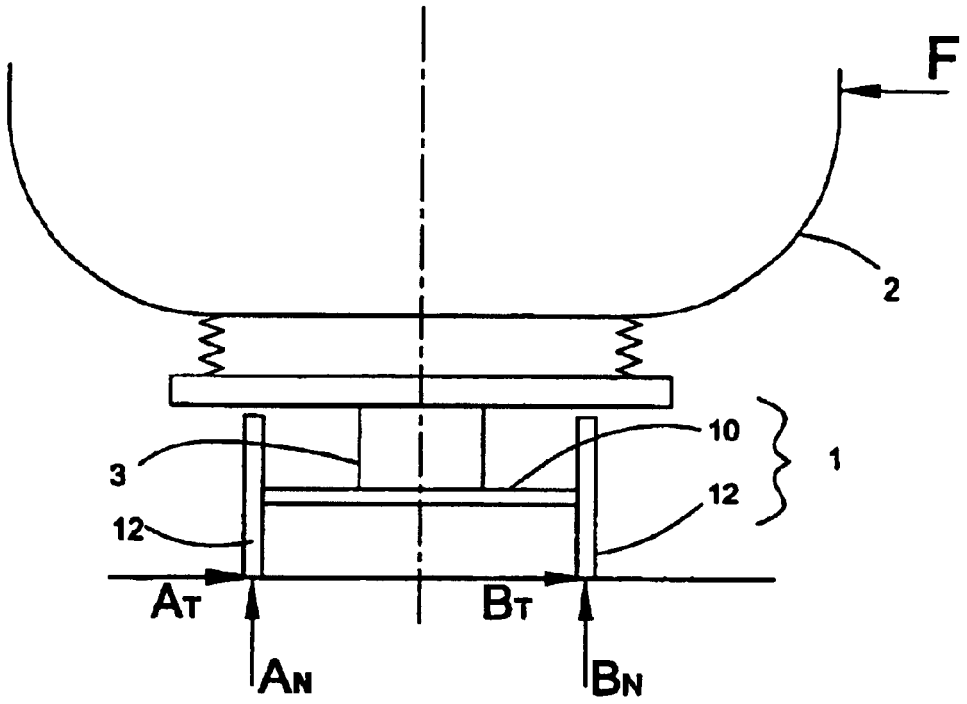
PRIOR ART Figure 2
FIG. 2 is a wheelset as found in the vehicle in FIG. 1, showing the forces acting at the wheel-to-guideway running faces.

FIGS. 1 and 2 show a vehicle running on a guideway (or track) of the type described in prior art. Such a vehicle incorporates two steerable wheelsets 1, attached to a vehicle body 2, and each wheelset 1 comprising axle 10 and two wheels 12. Steering actuators 3, are used to control the angle of the wheels with respect to the body. Sensors 4, detect the path error between the vehicle and guideway 5. A controller 6, processes the signals from the sensors and provides a control output to steering actuators 3. Upon detecting a path error, wheelsets 1 are steered in order to minimise the error.

Figure 3:
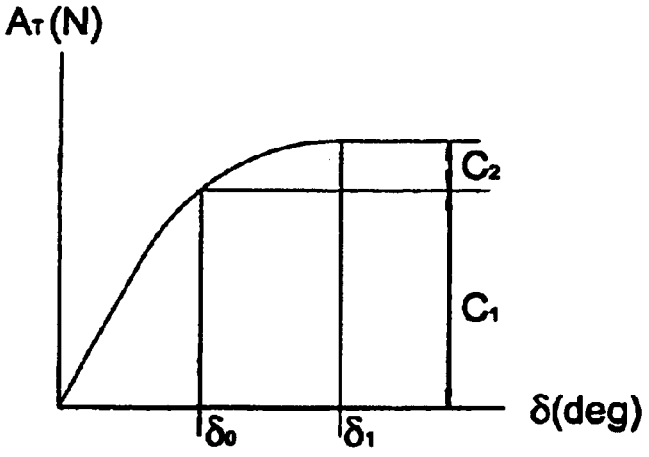
PRIOR ART Figure 3
FIG. 3 is a graph representing a typical relationship between side-force and slip angle for a wheel of the wheelset in FIG. 2, and showing the force available for steering the wheels.

In such a vehicle, axles 10 are substantially horizontal, as shown in FIG. 2. When a lateral force F is applied to the vehicle body 2, it is reacted by the wheel-to-guideway engagement forces. These reaction forces can be resolved into perpendicular components, $A_N$ and $B_N$, and parallel components, $A_T$, $B_T$. When a wheel is steered at an angle to its heading, generating a slip angle, small levels of slip at its contact zone generate a lateral force ($A_T$, $B_T$). This lateral force is related to this slip angle, with a typical relationship of the form shown in the graph of FIG. 3. Such a relationship depends on both the wheel and guideway materials, along with their surface texture and lubrication. The available side force reaches a maximum at a slip angle $\delta_1$, beyond which no additional side force is available. In the example shown in FIG. 2, wheelset 1 is steered so that lateral force F is reacted by a combination of $A_T$ and $B_T$ where $A_T$ is equal to $C_1$ as shown graphically in FIG. 3. To generate a force $C_1$ wheelset 1 must be steered so that wheel 12 generates a slip angle $\delta_0$ to its heading. Only the remaining force $C_2$ is available to steer wheelset 1. If the required side force exceeds $C_2$, steering control is lost, the wheel slides in the direction of force F and is unable to follow a desired path. In such an event, the wheelset must rely on other means, such as wheel flanges, to ensure it remains safely on the guideway.

Figure 4:
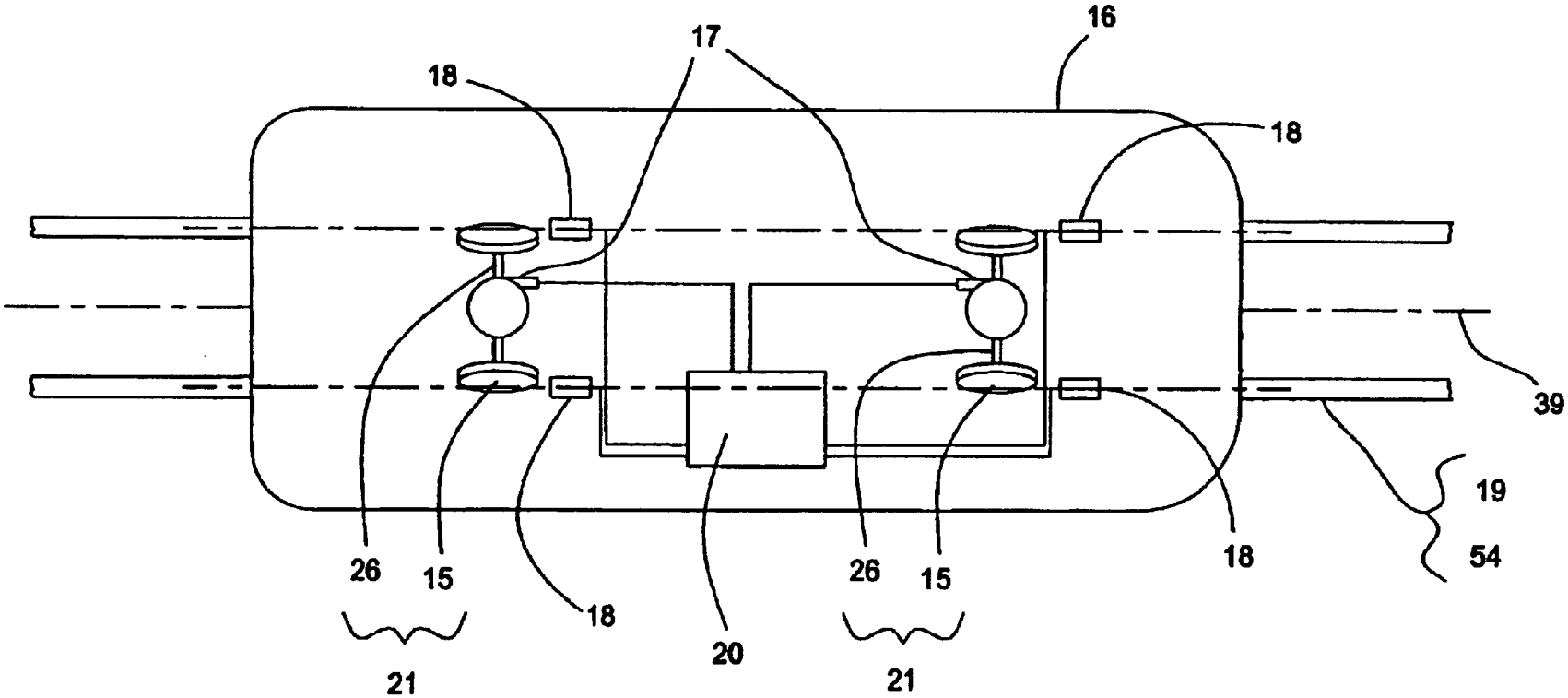
FIG. 4 shows a schematic representation of a vehicle in accordance with a first embodiment of the present invention.
Figure 5:
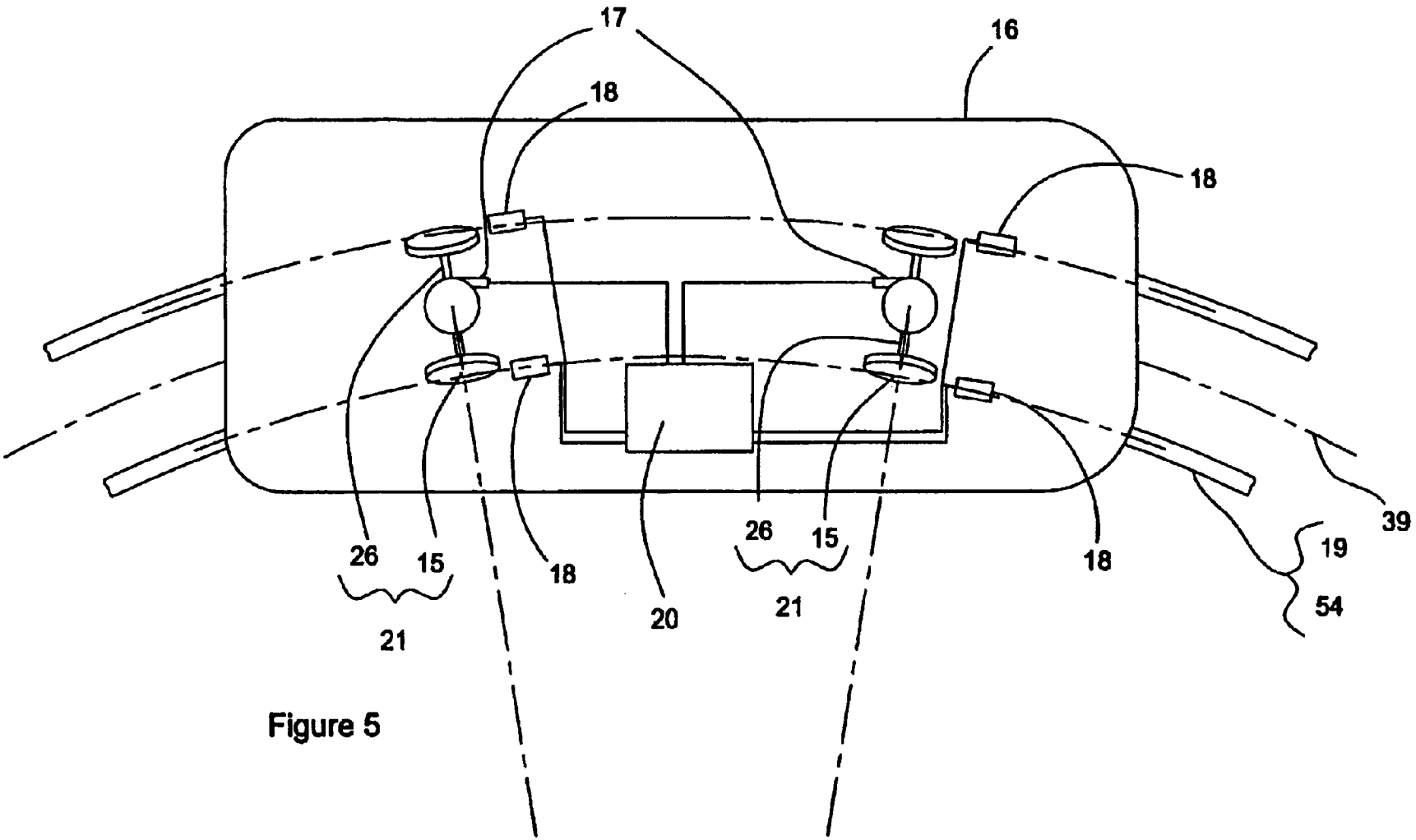
FIG. 5 shows a schematic representation of a vehicle as shown in FIG. 4 when the vehicle is in a turn.
Figure 6:
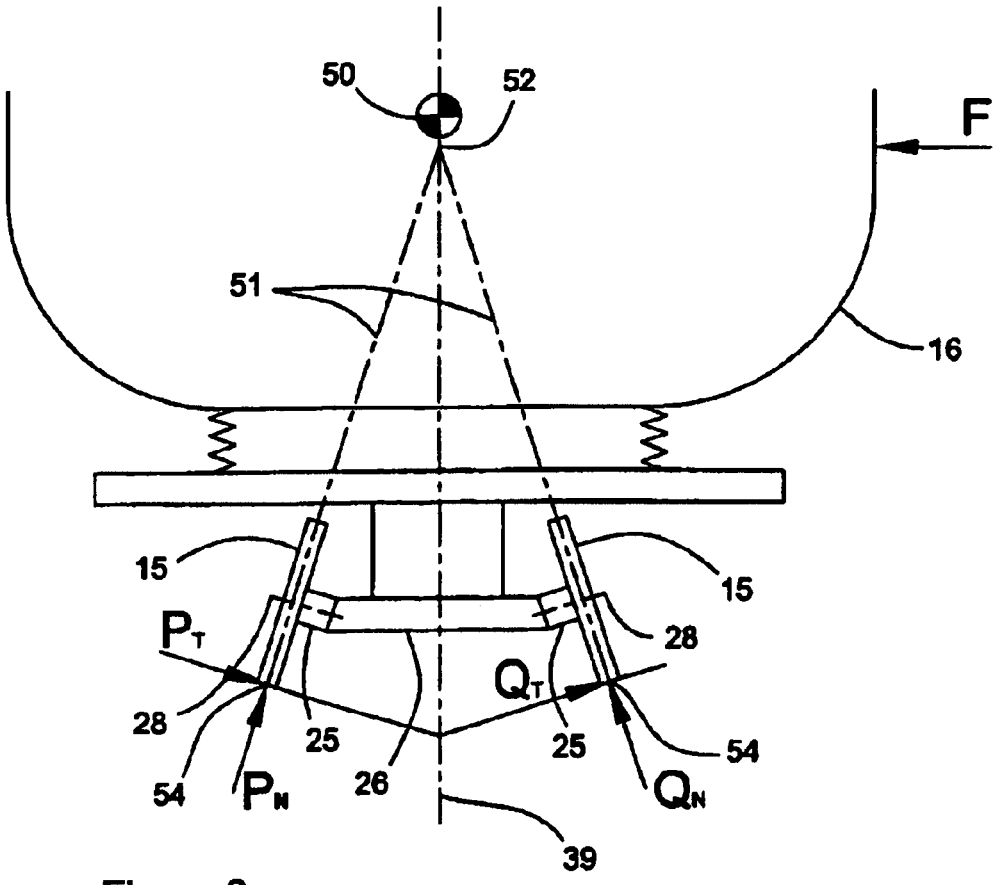
FIG. 6 is a wheelset of the vehicle as shown in FIGS. 4–5, showing the forces acting at the wheel-to-guideway running faces.

FIGS. 4 to 6 show a first embodiment of a vehicle according to the present invention comprising steerable wheelsets 21, each comprising axle 26 and two wheels 15 running on primary running faces 54 of guideway 19, attached to vehicle body 16. Steering actuators 17, are used to control the angle of wheelsets 21 with respect to vehicle body 16. Sensors 18, detect the lateral displacement between the vehicle and guideway 19. Controller 20 processes the signals from sensors 18, and provides an output to the steering actuators as a function of the lateral displacement of wheelset 21 with respect to guideway centreline 39. Upon detecting a lateral displacement error, wheelsets 21 are steered in order to minimise the error.

As shown in FIG. 6, axes of rotation 28 of wheels 15 (mounted to stub axles 25) are inclined downwardly towards guideway centreline 39, as are primary running faces 54 at the wheel-to-guideway rolling interface. When a lateral force F is similarly applied to vehicle body 16, it is reacted by the wheel-to-guideway engagement forces. These can be resolved into first perpendicular components, $P_N$ and $Q_N$ and second parallel components, $P_T$ and $Q_T$. Each of these has a component parallel to the applied lateral force F, and in combination react against this force.

Figure 7:
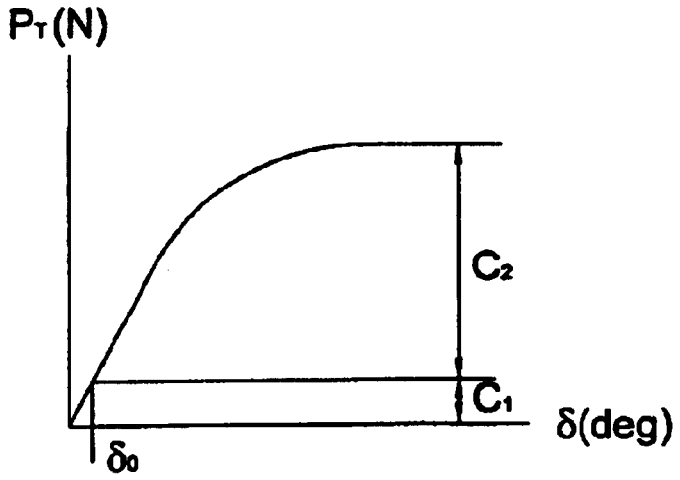
FIG. 7 is a graph similar to FIG. 3, showing the force substantially available to steer the wheels in accordance with the first embodiment of the present invention.

On entering a turn, sensors 18 detect the deviation of the vehicle from guideway centreline 39, and controller 20 responds by steering wheelset 21 in the direction to reduce the deviation to zero. The resulting slip angle $\delta$ produces lateral forces at the wheel-to-guideway interface, causing the vehicle to accelerate toward the instantaneous centre of curvature. The centrifugal force F, acting on the centre of gravity 50 of the vehicle, is substantially reacted by an increase in the normal force, $P_N$, on the outer wheel, rather than an increase of the tangential forces, $P_T$ and $Q_T$. If $P_T$ and $Q_T$ are small, then the wheels do not need to be operating at a very large slip angle $\delta_o$ as shown in FIG. 7. As a result, most of the maximum available tangential force, $C_2$, can be used to steer wheelset 21 and maintain its alignment with guideway centreline 39.

Figure 8:
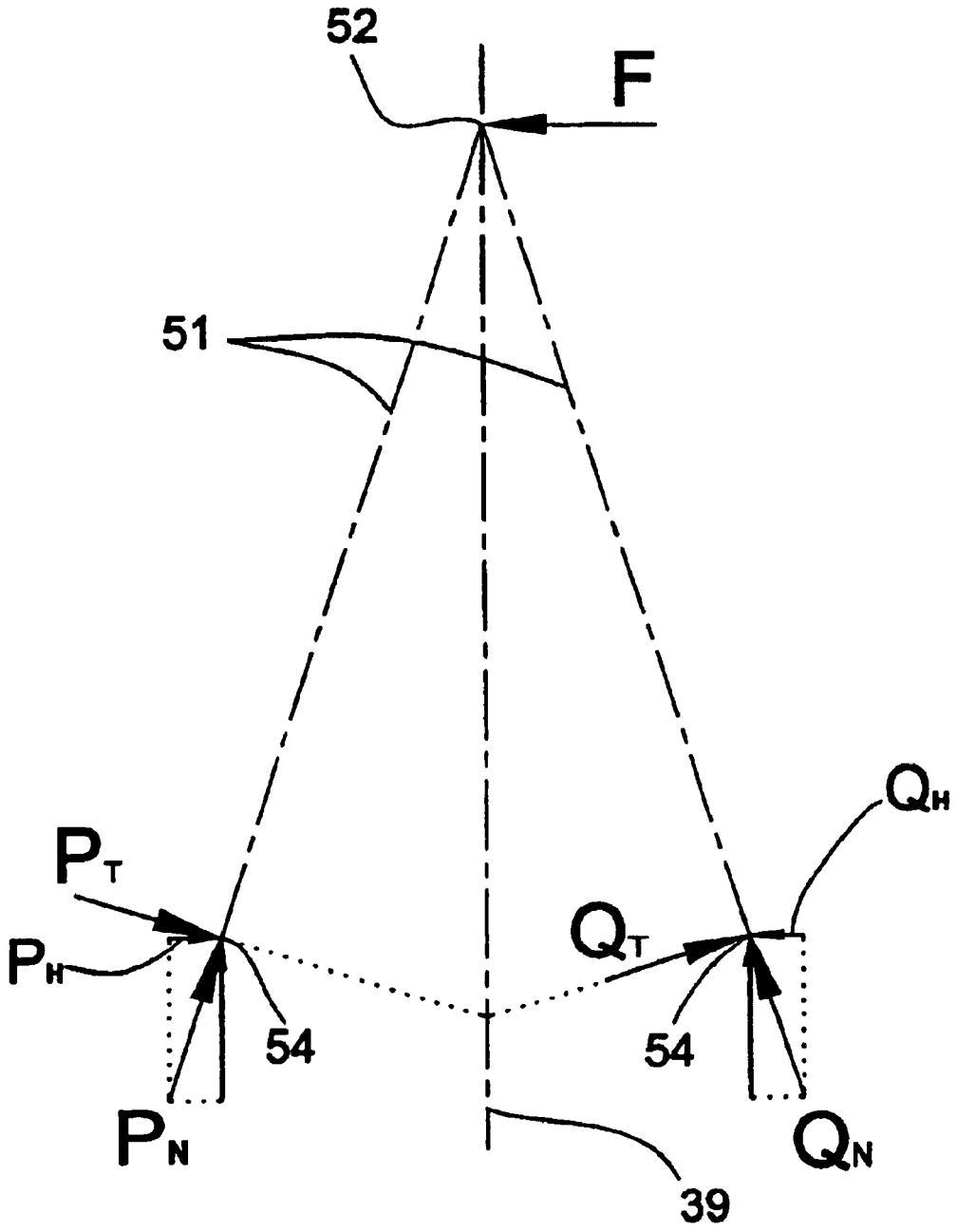
FIG. 8 is an illustration of the forces which act on the wheelset of the vehicle shown in FIG. 6.

It is preferred that vehicle centre of gravity 50 and wheels 15 are arranged such that centre of gravity 50 is near the intersection line 52 of wheel planes 51. In this configuration, the centrifugal forces or external disturbance forces acting on centre of gravity 50, are substantially resisted by an increase in the normal force, $P_N$, on the outer wheel, and corresponding decrease in the normal force $Q_N$ on the inner wheel. As shown in FIG. 8., the difference between the horizontal component $P_H$ of $P_N$ and the horizontal component $Q_H$ Of $Q_N$, substantially resists the sum of the centrifugal or external disturbance force F.

Figure 9:
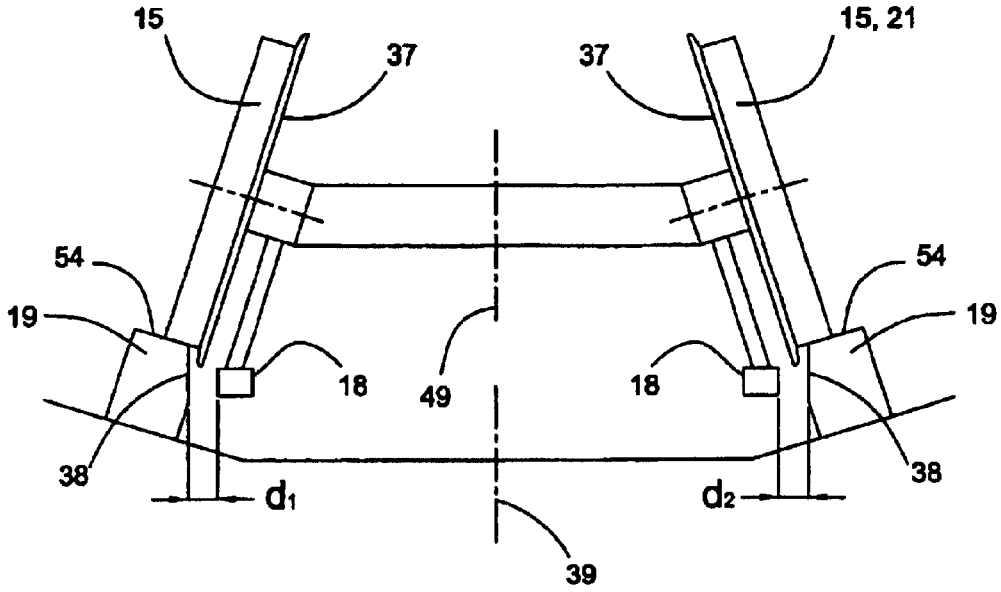
FIG. 9 is a wheelset and rails as described in a second embodiment of the present invention.

FIG. 9 depicts a second embodiment of the present invention, where the vehicle has a wheelset 21 comprising wheels 15 adapted to run on a guideway in the form of rails 19. Sensors 18 detect the proximity $d_1$, $d_2$ of the respective wheel 15 to the respective secondary running face 38 on rail 19. Sensed proximities $d_1$, $d_2$ are averaged to generate the lateral position of the centreline 49 of the wheelset 21, with respect to the guideway centreline 39. In this embodiment each of the wheels have a respective flange 37. Flange 37 engages with respective secondary running face 38 on rail 19 in the event of a steering failure, or excessive side load imparted on the vehicle via lateral acceleration or side wind loads. In other not shown embodiments, sensors 18 may detect the proximity of the wheels to some other feature on rail 19.

Figure 10:
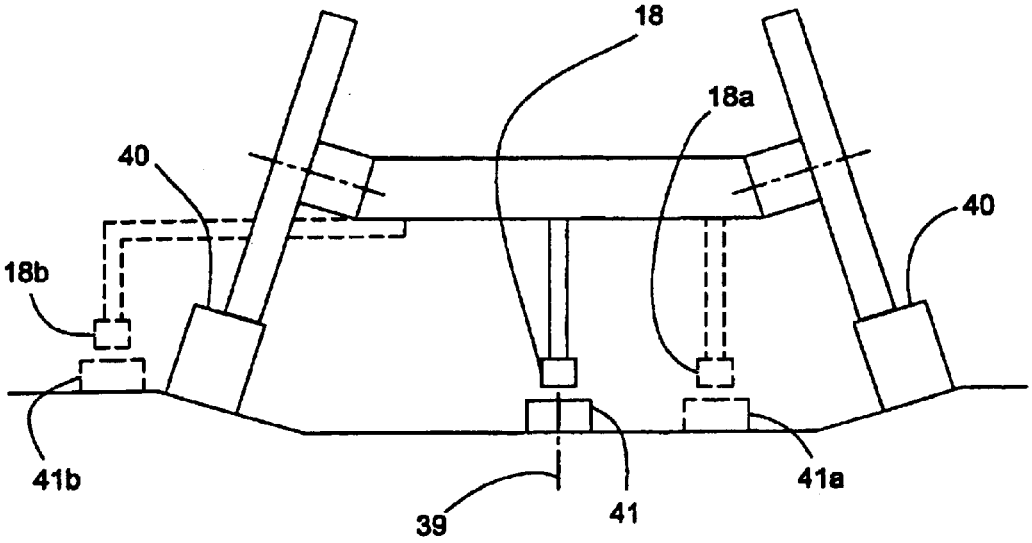
FIG. 10 shows a wheelset which is following a longitudinally disposed reference path other than the guideway centreline or secondary running face, according to a third embodiment of the present invention.

In a third embodiment of the invention as shown in FIG. 10, sensors 18 may sense a different path to that of guideway running faces 40. In this embodiment a longitudinally disposed reference path 41, corresponding to the guideway centreline 39, is used. However, it should be understood that such a path may physically lie between guideway running faces 40, as depicted by phantom lines as reference path 41*a* and sensor 18*a*, or outside guideway running faces 40, as depicted by phantom lines as reference path 41*b* and sensor 18*b*. Alternatively the reference path may be a virtual path, bearing some predetermined varying relationship to the guideway running faces 40.

In other not shown embodiments other means of supporting and steering the wheels may be used. These include steering of individual wheels about individual steering axes, rather than steering complete wheelset 21. Sensors 18, are attached to wheelset 21, and sense its lateral displacement with respect to each primary running face 54 of guideway 19 and hence with respect to guideway centreline 39. Sensors 18 are preferably located ahead of wheelset 21 and are connected to controller 20. In other not shown embodiments, sensors 18 may be located ahead, beside, and/or even behind the wheels.

Sensors 18, controller 20 and actuators 17 may include hydraulic or electrical devices and combinations thereof.

It will be recognised by persons skilled in the art that numerous variations and modifications may be made to the invention without departing from the spirit and scope of the invention.

What is claimed is:

1. A vehicle with at least one steerable wheelset adapted to run on a guideway having two primary running faces laterally offset about the centerline of the guideway, and at least one secondary running face lying adjacent to at least one of said primary running faces, the wheelset comprising a pair of wheels, each wheel located on opposite sides of the wheelset adapted to engage with a respective one of the two primary running faces, the vehicle further comprising sensing means for sensing lateral displacement of the wheelset with respect to the at least one secondary running face, the sensing means producing a signal for a control system operably connected to an actuating means to steer the wheels in response to the sensed lateral displacement, the axes of rotation of the wheels and the primary running faces are inclined downwardly toward the guideway centerline, and one of the wheels is adapted to engage with the at least one secondary running face.

2. A vehicle as claimed in claim 1, wherein each wheel exerts an engagement force with Its respective primary running face, the engagement force on each wheel comprising a perpendicular component to its respective primary running face and a parallel component to its respective primary running face substantially perpendicular to the guideway centerline, wherein horizontal forces acting on the wheelset substantially tranversed to the guideway centerline are substantially resisted by the sum of the horizontal vectors of the perpendicular components.

3. A vehicle as claimed in claim 1, wherein each wheel exerts an engagement force with its respective primary running face at a contact zone, the engagement force on each wheel comprising a first component perpendicular to its respective primary running face and a second component parallel to its respective primary running face substantially transverse to the guideway centerline; wherein a first plane perpendicular to the axis of rotation of one of the wheels passes through the centrcid of its respective contact zone, and a second plane perpendicular to the axis of rotation of the other wheel passes through the centroid of its respective contact zone, the first and second planes intersecting along an intersection line disposed above and between the wheels, wherein horizontal forces acting on the wheelset substantially transverse to the guideway centerline at or near the intersection line are substantially resisted by perpendicular components of the engagement forces acting at the primary running faces, such that substantially all of the parallel components of the engagement forces acting at the primary running faces are available to steer the wheelset.

4. A vehicle as claimed in claim 3, wherein the intersection line passes through the center of gravity of vehicle.

5. A vehicle as claimed in claim 1, wherein the sensing means comprises at least one sensor located either ahead or behind the wheelset, or laterally offset with the wheelset.

* * * * *